United States Patent [19]

Hausmann

[11] 4,264,304

[45] Apr. 28, 1981

[54] APPARATUS FOR FIXING IMAGES CONSISTING OF POWDER TONER ON A RECORDING CARRIER WITH THE AID OF SOLVENT VAPOR

[75] Inventor: Gerhard Hausmann, Olching, Fed. Rep. of Germany

[73] Assignee: Siemens Aktiengesellschaft, Berlin & Munich, Fed. Rep. of Germany

[21] Appl. No.: 67,960

[22] Filed: Aug. 20, 1979

[30] Foreign Application Priority Data

Sep. 6, 1978 [DE] Fed. Rep. of Germany ..... 2838864

[51] Int. Cl.[3] ..... F27B 9/28

[52] U.S. Cl. ..... 432/59; 34/153; 34/155

[58] Field of Search ..... 432/59, 60; 34/151, 34/152, 153, 155

[56] References Cited

U.S. PATENT DOCUMENTS

| | | | |
|---|---|---|---|
| 3,049,810 | 8/1962 | Iwerks | 34/151 |
| 3,704,524 | 12/1972 | Kamola et al. | 34/151 |
| 3,861,863 | 1/1975 | Kudsi | 432/60 |
| 3,886,668 | 6/1975 | Remond | 34/9 |
| 3,940,235 | 2/1976 | Weiler | 432/59 |

*Primary Examiner*—John J. Camby

*Attorney, Agent, or Firm*—Hill, Van Santen, Steadman, Chiara & Simpson

[57] ABSTRACT

A solvent vapor toner image fixing device for use with electrostatic devices is disclosed. The fixing device includes a fixing station having a well-shaped recepticle through which the paper web or the like is guided in a loop shaped manner. At the bottom of the recepticle a solvent vapor producing zone is provided through which the paper is passed. After leaving the solvent vapor fixing zone, the paper is guided out of the recepticle around a deflection cylinder. The solvent vapor zone is limited by cooling coils positioned above the fixing zone. The deflection mechanism for looping the paper through the recepticle is removable from the recepticle to allow ease of installation of the paper.

24 Claims, 3 Drawing Figures

APPARATUS FOR FIXING IMAGES CONSISTING OF POWDER TONER ON A RECORDING CARRIER WITH THE AID OF SOLVENT VAPOR

BACKGROUND OF THE INVENTION

1. Field of the Invention

This invention relates to electrostatic copying or printing devices and more particularly to a fixing station for fixing toner images in such devices.

2. Prior Art

This invention is directed to that class of device utilized for fixing powder toner images applied to a recording carrier such as a paper web by means of solvent vapor. In such devices a guidance mechanism guides the recording carrier through a housing in which the solvent vapor acts on the toner image applied to the paper to fuse the toner image to the paper.

Nonmechanical printing and copying apparatus utilizing electrostatic principles are known to the art. See, for example, U.S. Pat. No. 3,861,863, the teachings of which are herein incorporated by reference. In such devices toner images of the characters to be printed are first applied to a recording carrier such as a paper web. Application of the toner images can, for example, be applied to the paper web electrophotographically or electrographically creating a charged image on a photoelectric or dielectric intermediate carrier, usually a cylinder. The charge images are thereafter developed at a development station by application of a powdered toner. The resultant toner images are then transferred at a transfer station to the paper web. In order to affix the toner images in a smear free fashion to the paper, the toner must subsequently be bonded to the recording carrier at a fixing station.

Fixing stations at which the toner image is fused to the recording carrier are well-known. In one type of known fixing station the recording carrier, after leaving the toner transfer station, passes between two fixing cylinders with at least one of the cylinders heated. Through heat and pressure the toner particles are fused onto the recording carrier or paper. Fixing stations constructed according to this principle have a singular disadvantage in that the writing quality on the paper is or may be unfavorably influenced in numerous ways during passage through the fixing station. For example, the heated toner can adhere to the fixing cylinders and therefore, as a consequence, portions of the image can be mutilated. Additional disadvantages reside in the fact that the energy input for the heating station is relatively high and a rather expensive mechanism is required.

Another known method of fusing the toner to the paper utilizes a solvent vapor. See, for example, U.S. Pat. No. 3,049,810, the teachings of which are herein incorporated by reference. In this type of fixing station, solvent vapor is produced which is of a type capable of melting or liquifying the toner on the paper such that the liquified toner will penetrate the paper. The solvent vapor is supplied by a suitable apparatus directly to the paper in such a manner as to affect the toner images thereon. The fixing station may consist of a recepticle from which the solvent vapor is supplied or in which a vaporization device for the solvent is positioned. The fixing station generally includes a paper guiding mechanism by means of which the recording carrier or paper is guided through the recepticle. Preferably the fixing station is designed such that solvent vapors will not escape from it.

SUMMARY OF THE INVENTION

It is the principal object of this invention to provide an improved solvent vapor fixing station. Underlying objectives of this invention include the disclosure of a fixing station utilizing a solvent vapor whose manufacturing costs are low and where the fixing station is designed to significantly reduce or eliminate escape of solvent vapor. It is an additional object to provide such a fixing station with mechanism for directing the paper path through the station, the mechanism being removable from the station, or at least, in part, from the vapor section of the station.

These objects are achieved in that a solvent vapor recepticle into which the recording carrier is conveyable is designed having an open upper end. Adjacent the lower or bottom end a solvent supply installation is provided. A recording carrier or paper web guidance mechanism is arranged with respect to the recepticle such that a reversing member is arrangeable in the lower regions of the recepticle, the recording carrier being entrained about the reversing member such that the recording carrier is conveyed from the upper side of the recepticle down through the recepticle, reversed around the reversing member, and returned to the upper side, all with the toner coated side of the recording carrier being out of contact with the reversing member.

In order to avoid solvent vapor escape from the recepticle, the invention preferably includes cooling coils positioned in the section of the recepticle housing walls disposed above the fixation zone which will be saturated with solvent vapor.

In a preferred embodiment, the reversing member can be constructed as a rotatable cylinder.

A solvent supply device can be provided to supply solvent vapor in the fixation zone, the device including a vaporizer system. Solvent can then be supplied to the lower regions of the recepticle in the area of the fixing zone and thereafter heated and vaporized.

In a preferred embodiment of the paper feed system, the guidance mechanism will include an arcuate or saddle shaped upper guide member positionable over the open end of the recepticle and extending longitudinally to one side of the recepticle. The paper web or other recording carrier will therefore be conveyed to the recepticle over an arcuate depending saddle portion of the upper guide member with the recording carrier then extending downwardly into the recepticle thence about the reversing member and back towards the top of the recepticle. A second deflection or reversing member is preferably positioned adjacent to a side of the recepticle at a top thereof with the recording carrier coming from the reversing member and passing over the second reversing member and out of the fixing station.

In a modified form of the invention the guidance mechanism can be so constructed that the reversing member is capable of movement into and out of the fixation zone. Thus, it is movable from a fixation zone first position to a position adjacent the top of the recepticle closely spaced to the upper guide member. Preferably subsequently, the upper guide member and the reversing member can be moved from a position over the recepticle to a position remote from the recepticle. In this manner, the paper web or other recording carrier can be easily properly entrained or fed with respect to the overall guidance member and toner fixation system.

In order to accommodate ease of movement of the guide mechanism, one longitudinal side of the recepticle can be formed higher than the other longitudinal side. On the short longitudinal side the deflection or second reversing member can then be positioned. The upper guidance member can extend away from the recepticle on the lower longitudinal side. Additionally, the upper guidance member can be provided with a bridge member having a seal sealing against the deflection or second reversing member. At the same time a seal can extend from the short wall into contact with the second deflection member. In this manner, the recepticle can be sealed against escape of solvent vapor.

Additionally, in the recepticle itself, above the fixation zone, a holding position can be provided with the reversing member movable to that holding position, intermediate the fixation zone position and the upper guide member adjacent position. Thus, when prolonged pauses occur in the printing operation unnecessary moistening of the recording carrier by the solvent vapor can be reduced or eliminated.

Among other advantages, a device according to this invention has the following features. The recepticle can be relatively deep and open only at the top. In this manner the recording carrier can be substantially dried subsequent to leaving the fixation zone but prior to leaving the recepticle. The guidance mechanism is designable in such a manner that the toner applied side of the recording carrier, both prior to fixation and during drying, will not come into contact with any guide surfaces or reversing members. Only subsequent to drying of the recording carrier in the cooled zone above the fixation zone, will the toner applied side of the recording carrier be brought into contact with another surface. Due to the deeply drawn shape of the recepticle and the provision of cooling coils in the recepticle walls, leakage losses of solvent vapor will be minimized due to condensation of the solvent vapor below the top of the recepticle.

Additionally, manufacturing costs for a device according to this invention are relatively low and both operation sequencing and the manner of insertion or replacement of the recording carrier are relatively simple.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
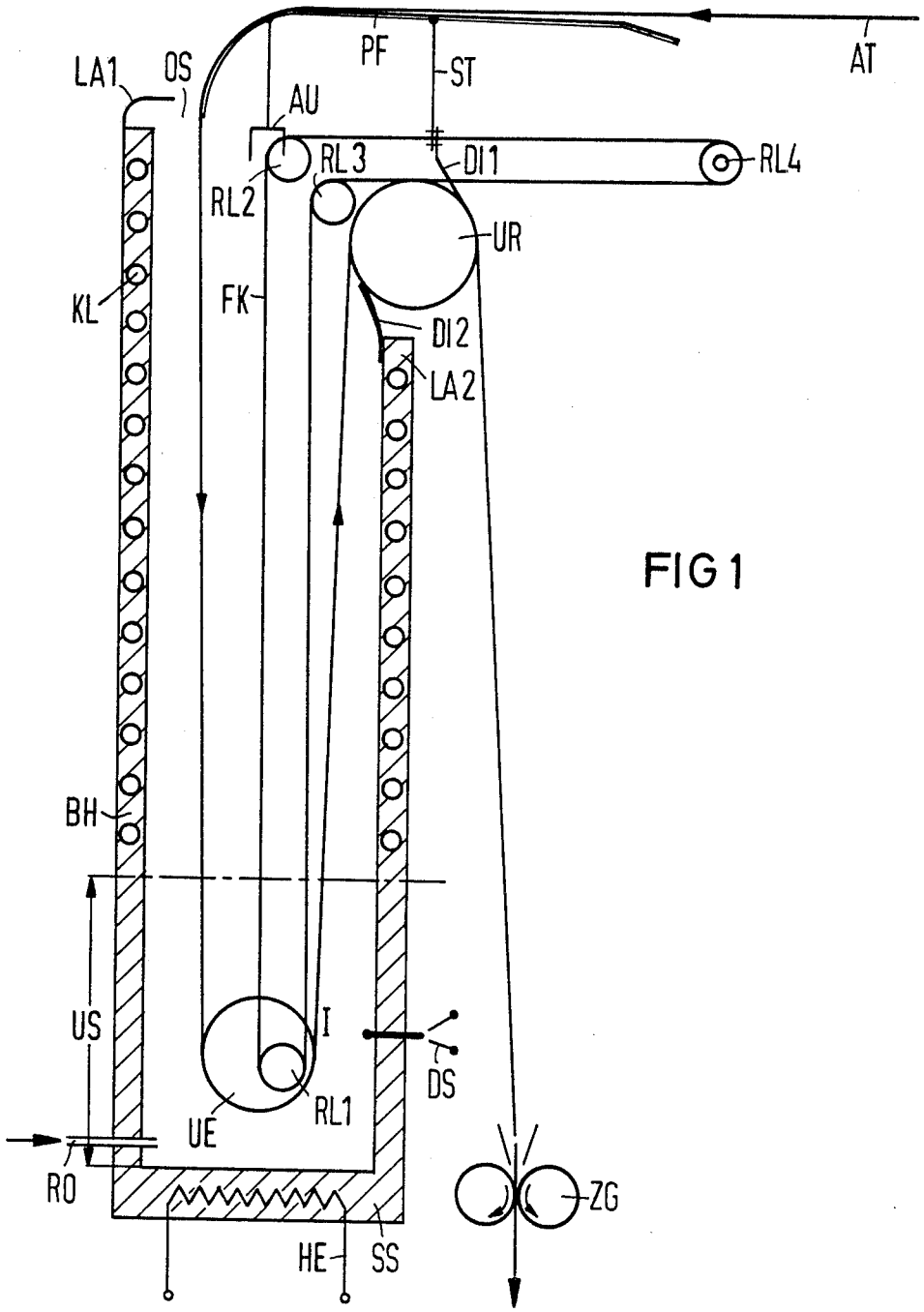
FIG. 1 is a diagrammatic illustration of a fixing station according to this invention with the reversing member positioned at the fixing zone.

FIG. 1 illustrates a toner fixing station according to this invention. The station includes a recepticle BH, illustrated in cross-section, and a guidance mechanism PF, UE, UR and RL. The fixation station is used to fix toner particles on a recording carrier or paper web AT by means of a solvent vapor. The recepticle BH is preferably designed as a relatively deep well member. The recepticle may be, for example, rectangular and is provided with five side walls being open only at the top OS.

The lower portion US of the recepticle is designated as a fixation zone and it is in this zone that fixation of the toner particles on the paper web AT takes place. Thus, in the zone US the solvent vapor is at such a concentration that the toner image is melted or liquified onto the paper web AT and will penetrate into the paper.

Solvent paper is provided to the fixation zone US. In the preferred embodiment solvent is delivered to the bottom of the recepticle BH by means of an inlet tube RO. At the bottom SS of the recepticle a heating installation HE; for example, a heating coil, is positioned. By means of activation of the heating coil in a known manner, the solvent in the bottom of the recepticle is heated to a temperature such that it is vaporized. In order to control vapor concentration in the fixation zone US, a vapor sensor DS can be provided for controlling either flow of solvent through the tube RO or control of the heating coil HE or both. Action of the vapor sensor DS and its controls are known to the art.

In order to fix the toner on the paper it is necessary that the paper web be transported to the fixation zone US. To this end, a guidance mechanism is provided. The guidance mechanism includes a reversing member UE about which the paper web AT is entrained. The reversing member UE is, during fixation, positioned towards the bottom of the recepticle BH and within the fixation zone US. In the illustrated embodiment, the reversing member UE is a cylinder which may be rotatable. The recording carrier AT is reversed about the reversing member UE in such a manner that the recording carrier proceeds downwardly towards the bottom of the recepticle BH into the fixation zone US where it then reverses about the cylinder UE and then proceeds back upwardly through the recepticle in a loop shaped fashion. The paper AT enters the recepticle at the open top OS, proceeds around the reversing member UE and exits the recepticle again at the open top OS.

In order to limit escape of solvent vapor from the fixation zone US, the recepticle can be provided with cooling coils KL in the recepticle walls or affixed to the recepticle walls above the fixation zone. Solvent vapor emerging from the fixation zone US will then arrive at a cooled zone causing the vapor to condense. In order to enhance the efficiency of the operation and to limit or eliminate escape of solvent vapor, it is preferred to use a solvent which in its vapor form is heavier than air.

In a construction of this type the vapor concentration is not suddenly reduced. During transition from the fixation zone US to the cooled zone, the vapor concentration reduces gradually. However the vapor concentration is great enough to produce fixation only in the fixation zone such that the toner particles will begin to dry or solidify as the toner leaves the fixation zone and begins to pass through the cool zone.

The guidance mechanism in addition to the reversing member UE includes an upper support or guide member PF which has an arcuately curved or saddle shaped end which is positionable to overlie the opening OS to the recepticle. Additionally, the guidance mechanism includes a deflection member or second reversing cylinder UR. The upper guide member PF is positioned adjacent to a longitudinal side LA1 of the recepticle when in the fixation position. The saddle end of the upper guide member PF is spaced from the side LA1 so that the end of the arcuate saddle shape is directed towards the opening OS. The recording carrier AT is then guided around the arcuate end of the upper guide member and into the opening OS of the recepticle BH. Deflection or reversing cylinder UR is positioned adjacent the other longitudinal side LA2 of the recepticle BH. The paper web or recording carrier is directed about the second reversing member UR upon leaving the recepticle BH.

In the preferred embodiment, the one longitudinal side LA1 of the recepticle is higher than the opposed longitudinal side LA2. In this manner, the upper guide member can be provided with a depending support or bridge member ST to which a seal DIA is affixed, the seal, which may, for example, be a lip type seal, resting against the outer surface of the cylinder UR.

Between the cylinder UR and the recepticle wall LA2, a second seal, which may again be a lip seal, DI2, can be provided. By means of the seals D11 and DI2 and the bridge structure ST and undersurface of the upper guide member PF, it can be assured that escape of solvent vapor from the recepticle BH is eliminated or minimized.

The recording carrier AT, after fixation in the zone US, will traverse a comparatively long stretch within the recepticle BH. This long stretch provides a drying zone. Drying commences shortly above the fixation zone US and by properly sizing the drying zone, the recording carrier will reach the cylinder UR in a substantially dried state. Thus, by passing the toner applied side of the recording carrier paper web over the cylinder UR, it can be assured that due to proper drying within the drying zone, the toner images will not be smeared.

The recording carrier movement can be controlled by means of pressure rollers ZG which can be motor driven exterior of the recepticle BH.

The guidance mechanism is illustrated in FIG. 1 in fixation position with the reversing member UE positioned in the fixation zone US of the recepticle BH. This position is identified as position I. In order to facilitate insertion of the paper web or recording carrier AT the guidance mechanism can be moved. Thus, the reversing member UE can be moved from the fixation position I to a first position II shown by solid lines in FIG. 3. In the first position II the reversing member UE is positioned at the top of the recepticle in the open end US. At that position it may seat in seat member AU depending from the guidance mechanism upper guide member PF. In order to move the reversing member UE from the fixing position to the first position II, a guide chain or drive FK can be provided which is shown in principle in FIG. 1. The guide chain FK is guided about a roller RL1 at the fixation zone and about roller RL2 and 3 and a drive roller RL4. The roller RL2 is adjacent to the support AU of the upper guide member PF in such a manner that the chain FK leads from the fixation zone roller RL1 to the member AU.

If the reversing roller UE is to be moved from the fixing position I to the first position II, the guide chain FK is moved by the drive roller RL4. During such movement the reversing roller UE moves upwardly until it reaches the seat AU where it is rested. This position is illustrated by solid lines in FIG. 2.

Figure 3:
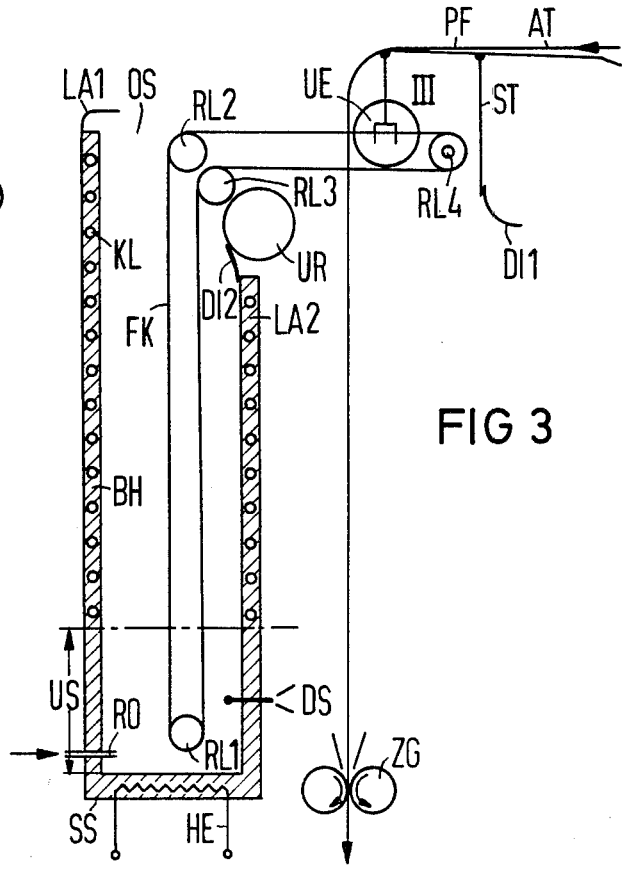
FIG. 3 is a view similar to FIGS. 1 and 2 illustrating positioning of the reversing member at a recording carrier installation position.

In order to further facilitate insertion of the paper web AT the entire upper recording carrier guidance member PF can be moved from the upper open end OS of the recepticle BH. To this end, the guide chain FK is further moved by means of the roller RL4. Since the reversing member UE is supported in the seat member AU, the entire upper guide member PF will move laterally with movement of the reversing member attached to the chain FK. Thus, the upper guide member PF will be transported in the direction of the drive roller RL4. The final position is illustrated in FIG. 3 and is indicated as position III. The recording carrier AT can now be inserted in a simple fashion as illustrated in FIG. 3, it being understood that the rollers RL and guide chain are positioned off to one side.

Figure 2:
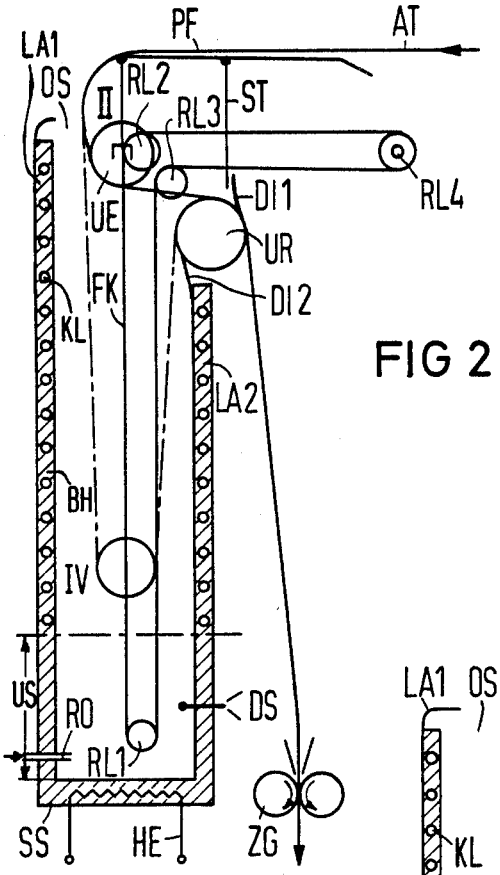
FIG. 2 is a view similar to FIG. 1 illustrating intermediate positionings of the reversing member.

When the reversing member UE is to again be brought into the fixing position the guide chain FK is reversed in its movement and is moved by means of the drive roller RL4 to return first the upper guide member to its insertion position illustrated by solid lines in FIG. 2. Further movement of the guide chain will then transport the reversing member down into the recepticle from position II to position I.

In the case of long periods of nonoperation, it is desirable to remove the paper web from the fixation zone US. To this end, an intermediate stop point for the reversing member UE can be provided within the length of the recepticle BH. This intermediate stop point is shown as position IV of FIG. 2 with the path of the paper web being illustrated by broken lines.

It should be understood that various supports and mounts for the mechanisms illustrated in the drawings can be designed by those skilled in the art. For example the upper guide member PF could be supported on linear roller bearing sets or the like. The attachment of the reversing members UE and UR is preferably a rotatable axle. In order to adequately support the reversing member UE, two sets of guide chains can be provided with the axle of the roller UE affixed to a point on the chain. Additionally, although an endless chain FK has been shown, since the movement mechanism is a reverse mechanism, the drive chain could be cable wrapped around capstans RL1 and RL4.

Other modifications in the construction and modification of this device will be readily apparent to those skilled in the art.

Although the teachings of my invention have herein been discussed with reference to specific theories and embodiments, it is to be understood that these are by way of illustration only and that others may wish to utilize my invention in different designs or applications.

I claim as my invention:

1. A device for fixing toner powder images applied to a recording carrier by means of a solvent vapor by guiding a recording carrier by a guidance mechanism through a fixing housing comprising: a housing being a relatively deep five sided recepticle having an open top, side walls and bottom, a solvent vapor providing mechanism positioned in lower regions of the housing, the guide mechanism including a reversing member positionable with a fixation zone adjacent the bottom of the housing, means directing the recording carrier downwardly into the recepticle from adjacent the open end thereof, thence around the reversing member, thence back to the open end of the housing with a toner coated face of the recording carrier maintained out of contact with the reversing member.

2. A device according to claim 1 wherein the recepticle is provided with cooling means, the cooling means being positioned above the fixation zone spaced from a bottom of the recepticle.

3. A device according to claim 2 wherein the cooling means are cooling coils embedded in the walls of the recepticle.

4. A device according to claim 2 wherein the cooling means are cooling coils affixed to side walls of the recepticle.

5. A device according to claim 1 wherein the reversing member is a cylinder.

6. A device according to claim 1 wherein an upper guide member is positionable over the open end of the recepticle, the upper guide member including a generally arcuate cross-sectional saddle member positionable over the open end of the recepticle, the saddle member effective to direct a recording carrier passing thereover downwardly into the recepticle.

7. A device according to claim 6 wherein the guidance mechanism further includes a second reversing member positioned adjacent a top of one longitudinal side of the recepticle, the second reversing member extending in parallel with the first reversing member and means directing a recording carrier passing around the first reversing member upwardly through the recepticle thence around the second reversing member.

8. A device according to claim 7 wherein the first reversing member is movable from a fixing position in the fixing zone to a position adjacent the open top of the recepticle and means for moving the reversing member are provided.

9. A device according to claim 8 wherein the upper guide member is equipped with means contacting the reversing member when the reversing member is at a position adjacent the open end of the recepticle.

10. A device according to claim 9 wherein the upper guide member is laterally movable with respect to the recepticle, means for moving the upper guide member and reversing member laterally from a position substantially over an open end of the recepticle to a position remote from the recepticle.

11. A device according to claim 10 wherein the lateral movement of the upper guide member and reversing member is controlled by drive means affixed to the reversing member.

12. A device according to claim 10 wherein the recepticle has opposed first and second longitudinal sides, the first longitudinal side having a top higher than the top of the second longitudinal side, the second reversing member extending parallel to the second longitudinal side spaced above the top thereof, the upper guidance member being positioned above the top of the second reversing member, seal means extending between the upper guide member and the second reversing member and second seal means extending between a top of the second wall and the second reversing member.

13. A device according to claim 10 wherein an intermediate stop position is provided for the reversing member intermediate the fixation zone and the top of the recepticle, the reversing member being movable between a fixation position adjacent a bottom of the recepticle within the fixation zone and a position adjacent an open top of the recepticle with said intermediate position lying within an area of the recepticle cooled by cooling means.

14. A toner fixation device for use in electrophotostatic printing devices comprising a relatively deep recepticle having at least four side walls, a bottom and an open top having a solvent vapor fixation zone adjacent a bottom thereof spaced from an open top thereof and guide means for guiding a paper from the open top into the recepticle thence downwardly into the fixation zone thence around a reversing device located within the fixation zone thence upwardly to the open top.

15. A device according to claim 14 wherein the fixation zone includes means for providing a solvent vapor to said fixation zone.

16. A device according to claim 15 wherein the recepticle includes cooling means positioned above the fixation zone.

17. A device according to claim 16 wherein the reversing means is movable from the fixation zone to adjacent the open top of the recepticle and means for moving the reversing member are provided.

18. A device according to claim 17 wherein the recepticle has opposed first and second side walls, the first side wall having a top surface positioned above a top surface of a second side wall.

19. A device according to claim 18 wherein the reversing member is movable from a position adjacent an open top of the recepticle to a position laterally to a side of the recepticle.

20. A device according to claim 19 including an upper guide member positionable above the open top of the recepticle, the upper guide member including arcuate support means for directing a paper to be fixed downwardly into the open top of the recepticle towards to reversing member when the reversing member is located in the fixation zone, the upper guide member being movable laterally above the recepticle independent response to the movement of the reversing member laterally of the recepticle.

21. A device according to claim 20 including drive means for movement of the reversing member and upper guide member.

22. A device according to claim 21 including a second reversing member positioned above the top of the second lateral wall and a flow path for paper extending over the upper guide member then downwardly through the recepticle, then around the first reversing member, then upwardly toward the top of the recepticle, thence around the second reversing member.

23. A device according to claim 10 wherein the recepticle is provided with cooling means, the cooling means being positioned above the fixation zone spaced from a bottom of the recepticle.

24. A device according to claim 23 wherein the cooling means are cooling coils embedded in the walls of the recepticle.

* * * * *